United States Patent [19]

Borom

[11] 4,134,777

[45] Jan. 16, 1979

[54] METHOD FOR RAPID REMOVAL OF CORES MADE OF $Y_2O_3$ FROM DIRECTIONALLY SOLIDIFIED EUTECTIC AND SUPERALLOY MATERIALS

[75] Inventor: Marcus P. Borom, Schenectady, N.Y.

[73] Assignee: General Electric Company, Schenectady, N.Y.

[21] Appl. No.: 839,993

[22] Filed: Oct. 6, 1977

[51] Int. Cl.[2] ..... B22D 29/00

[52] U.S. Cl. ..... 134/2; 106/38.9; 134/19; 134/22 R; 156/656; 156/667; 164/132

[58] Field of Search ..... 29/156.8 H, 156.8 T; 75/101 BE; 134/2, 22 R, 29, 19; 106/55, 73.2, 38.9; 164/131, 132; 252/455, 454, 477 R, 79.5; 423/21; 156/637, 655, 656, 667

[56] References Cited

U.S. PATENT DOCUMENTS

| | | | |
|---|---|---|---|
| 3,407,864 | 10/1968 | Anderko et al. | 106/38.9 |
| 3,473,599 | 10/1969 | Rose | 164/134 |
| 3,576,653 | 4/1971 | Miller et al. | 106/63 |
| 3,578,391 | 3/1971 | Chiola et al. | 423/21 |
| 3,594,118 | 7/1971 | Dodds | 423/21 |
| 3,643,728 | 2/1972 | Hulse | 106/38.9 |
| 3,658,486 | 4/1972 | Goto | 423/21 |
| 3,694,264 | 9/1972 | Weinland et al. | 134/2 |
| 3,727,670 | 4/1973 | Bailey | 164/132 |
| 4,040,845 | 8/1977 | Richerson et al. | 106/55 |

OTHER PUBLICATIONS

*Handbook of Chemistry & Physics*, 48th Ed., The Chemical Rubber Co., (1958), p. B-239.

Tsutsumi, T., *Chemical Abstracts*, vol. 81, (1979), p. 256.

*Primary Examiner*—Jerome W. Massie

*Attorney, Agent, or Firm*—Donald M. Winegar; Joseph T. Cohen; Charles T. Watts

[57] ABSTRACT

Caustic solutions are employed in an autoclave process to rapidly remove the cores made of $Y_2O_3$ from directionally solidified eutectic alloy and superalloy materials.

8 Claims, No Drawings

METHOD FOR RAPID REMOVAL OF CORES MADE OF $Y_2O_3$ FROM DIRECTIONALLY SOLIDIFIED EUTECTIC AND SUPERALLOY MATERIALS

RIGHTS GRANTED TO THE UNITED STATES OF AMERICA

The Government of the United States of America has rights in this invention pursuant to Contract No. F33615-76-C-5110 awarded by the Department of the Air Force.

BACKGROUND OF THE INVENTION

1. Field of the Invention

This invention relates to improvements in investment casting and in particular to the rapid removal of cores made of $Y_2O_3$ employed in the casting process.

2. Description of the Prior Art

The production of directionally solidified (DS) metal eutectic alloys and superalloys for high pressure turbine (HPT) airfoils with intricate internal passageways for air cooling requires that the core and mold not only be dimensionally stable and sufficiently strong to contain and shape the casting but also be sufficiently weak to prevent mechanical rupture (hot cracking) of the casting during solidification and cooling. The DS process requirements of up to 1875° C. for a 16 hour time period imposes severe constraints on materials which may serve as mold or core candidates.

The currently available core materials do not possess the chemical stability required for casting eutectic alloy and superalloy materials. The prior art appears to be mostly limited to the use of silica or silica-zircon core and mold materials. At temperatures greater than 1600° C. the silica based materials fail from the standpoint of both mechanical integrity and chemical incompatibility with the advanced alloy compositions.

Yttrium oxide ($Y_2O_3$) by itself, without a chemical or physical binder material, has been identified as a potential core and mold material based on both chemical compatibility and leachability considerations.

Cores made from the $Y_2O_3$ material must be removed from the castings without any deleterious effect on the surface of the casting.

It is therefore an object of this invention to provide a new and improved method for removing yttria ($Y_2O_3$) core material from directionally solidified eutectic alloy and superalloy materials.

Another object of this invention is to provide a new and improved method for the rapid removal of yttria core material by a caustic solution in an autoclave without adversely affecting the cast metal.

Other objects of this invention will, in part, be obvious and will, in part, appear hereinafter.

BRIEF DESCRIPTION OF THE INVENTION

In accordance with the teachings of this invention there is provided a new and improved method for removing a core of yttria ceramic material from an abutting contact relationship with a casting of an advanced superalloy material.

The yttria ceramic material is removed by an autoclave leaching process at an elevated temperature and an elevated pressure. An aqueous solution of either KOH or NaOH comprises the leaching solution. The elevated temperature in an autoclave is at least about 200° C. and may range up to about 350° C. and higher.

A preferred temperature for leaching is about 290° C. The leaching solution attacks the yttria grains by dissolving some of the same and washes the remainder of undissolved material out of the casting by agitation of the solution and the ongoing chemical reaction. KOH is the preferred leaching agent.

Advanced superalloys, such as NiTaC-13, are not attacked by the core material or the leaching solutions.

DESCRIPTION OF THE INVENTION

A compact made of pressed and sintered yttria ($Y_2O_3$) is suitable for use as a core in investment casting of directionally solidified eutectic and superalloy materials. The compact may have a complex shape because of the turbine blade to be made by the casting process. The yttria material for the compact or core is employed because casting temperatures are in excess of about 1600° C. and directional solidification is practiced for 16 hours and more.

After the compact of yttria has been employed as a core in making a casting, and the casting has solidified thereabout, the core is removed from the casting by autoclave leaching employing either a KOH or a NaOH aqueous solution. A solution of from about 10 weight percent of either KOH or NaOH in water up to saturation, about 70 weight percent in water, has been found to be satisfactory. The autoclave temperature is preferably greater than about 200° C. and may range upwards to at least about 350° C. and higher. The temperature preferably should not exceed about 290° C. The autoclave pressure is generated by the vapor pressure above the liquid which results from the leaching process. The pressure in the autoclave leaching process may be of the order of from 200 psi to about 1250 psi.

The caustic leaching agent, during the autoclave leaching process, attacks the ceramic material of the core. In the instance of the yttria core made from the compact, the leaching agent dissolves the yttria of both the grains and the interconnecting bridges therebetween formed by sintering of material of adjacent grains. When the bridges have been dissolved, the remainder of the core material, mostly grannular material, is physically washed out of the core cavity by agitation caused by the leaching process. Any remaining material may be removed by mechanical agitation after removal from the autoclave by such suitable means as ultrasonics and the like.

After completion of the autoclave leaching process to remove the yttria core, the casting is removed from the autoclave, washed in water and dried in a warm oven. The casting is then stored for further use or processed further as required.

Examination of castings of directionally solidified eutectic and superalloy materials such, for example, as NiTaC-13, cast with the yttria cores, revealed no apparent attack on the cast metal. The surface finishes of the castings are acceptable regardless of whether the leaching agent is KOH or NaOH and regardless of the strength of the solutions of the same. The KOH and the NaOH have no detrimental effect on the finish or integrity of the superalloy casting.

I claim as my invention:

1. A method for removing a core made of yttria ceramic material having a grain morphology which is characteristic of grains which have undergone partial sintering resulting in a network of narrow interconnecting bridges formed by sintering and which connect adjacent grains and particles, comprising the process steps of:

(a) placing the casting and the core of yttria ceramic material in an autoclave containing an aqueous leaching solution containing a material which is one selected from the group consisting of NaOH and KOH;

(b) heating the casting, yttria ceramic material and leaching solution to a temperature of at least about 200° C.;

(c) dissolving substantially all of the interconnecting network of ceramic material by chemical attack by the leaching solution, and (d) removing at least some of the undissolved ceramic material from the casting by the solution agitated by the chemical reaction.

2. The method of claim 1 wherein the temperature in the autoclave is no greater than about 350° C.

3. The method of claim 1 wherein the composition of the leaching solution is from about 10 percent by weight to about 70 percent by weight hydroxide and the balance water.

4. The method of claim 3 wherein the hydroxide is NaOH.

5. The method of claim 3 wherein the hydroxide is KOH.

6. The method of claim 1 wherein the temperature in the autoclave is about 290° C.

7. The method of claim 6 wherein the hydroxide is NaOH.

8. The method of claim 6 wherein the hydroxide is KOH.

* * * * *